US006638125B1

(12) United States Patent
Mossel

(10) Patent No.: US 6,638,125 B1
(45) Date of Patent: Oct. 28, 2003

(54) TOW-BEHIND WATERSPORTS DEVICE

(76) Inventor: Paul Mossel, 8468 San Clemente Way, Buena Park, CA (US) 90620

( * ) Notice: Subject to any disclaimer, the term of this patent is extended or adjusted under 35 U.S.C. 154(b) by 0 days.

(21) Appl. No.: 10/153,732

(22) Filed: May 24, 2002

(51) Int. Cl.[7] ..... B63D 35/73
(52) U.S. Cl. ..... 441/65; 114/55.52; 114/253
(58) Field of Search ..... 441/65; 114/253, 114/254, 55.52; D12/8; 280/14.27, 14.28

(56) References Cited

U.S. PATENT DOCUMENTS 3,027,574 A * 4/1962 Meehan ..... 441/69
3,120,833 A * 2/1964 Curelich ..... 440/27
3,803,653 A * 4/1974 Trostad ..... 441/72
3,989,002 A * 11/1976 Peterson ..... 114/55.56
4,474,502 A * 10/1984 Daoud ..... 440/29
4,756,700 A * 7/1988 Coleman ..... 441/65
4,872,861 A * 10/1989 Gaudin ..... 441/79
5,076,189 A * 12/1991 Jones ..... 114/253

* cited by examiner

*Primary Examiner*—Sherman Basinger
(74) *Attorney, Agent, or Firm*—Nath & Associates PLLC; Gary M. Nath; Lee C. Heiman

(57) ABSTRACT

This invention relates to novel non-motorized water sports devices which facilitate and improve the usage of "tow-behind" water sports devices. Said devices of the present invention comprise a hull having an aft deck surface sized for accommodating at least one rider; at least one tow attachment point; a handle column; a handle bar attached to said handle column; and at least one rudder fin attached to said hull. Said devices are usually towed by a watercraft having a propulsion mechanism, by means of a tow rope or similar device(s).

4 Claims, 9 Drawing Sheets

TOW-BEHIND WATERSPORTS DEVICE

BACKGROUND OF THE INVENTION

1. Field of Invention

The present invention relates to novel non-motorized water sports devices, as more particularly described herein. The devices of the present invention are towed behind a separate watercraft having its own propulsion system, such as a powerboat, by means of a tow rope or similar device(s).

Existing watersports technologies include traditional waterskis, kneeboards and wakeboards, surfboards, and personal water craft ("PWC") and "jetskis". The present invention has one or more feature(s) in common with each of these existing technologies, producing a novel combination not known in either the tow-behind watersports field or the non-motorized watersports field.

2. Background

"Tow-behind" Water Sports Devices. Conventional water skis are traditionally elongated members which have a forwardly extending prow or nose and a flat body of a generally uniform thickness and width. Such traditional "tow-behind" water sports devices generally have bindings or stirrups for one or two feet, and the stirrups may comprise heel and toe pieces or toe pieces only. One or two skis may be utilized by waterski users. The waterski user is generally required to utilize the hands and arms to hang on to the handle or handles of a tow rope as the means of connection to the tow vehicle. The waterski user is also required to use muscle tension to balance against the pull of the tow vehicle in order to create and maintain a planing condition of the ski(s) on the water surface, potentially a significant strain on the muscles of the legs, lower back, hands, and arms for many individuals.

Kneeboards and wakeboards provide the advantage of relieving the user of the burden of holding a tow rope and balancing against the pull of the tow vehicle. However, such devices significantly lack maneuverability and force the user to remain in a kneeling or prone position.

The present invention relates to modified water sport devices which facilitate and improve upon the usage of "tow-behind" water sports devices. The inventive devices permit the user to more comfortably kneel or stand on the device and to avoid tow rope fatigue, yet provide a more maneuverable and more stable ride compared to existing devices.

Non-motorized Water Sports Devices. Putting aside passive floating devices such as inflatable tubes and mattresses, there are two primary non-motorized water sports devices which one might ride without attachment to a tow vehicle: surf boards and body boards (also known colloquially as boogie boards), which are "powered" by breaking waves. Although there are significant differences between these devices, common elements include an elongated, positively buoyant, tapered body; control surfaces, whether fins attached to the body or body contours; and a "leash" device for keeping the board within reach of the user in the event of a spill during use. Significantly, such board-type devices may require the user to have significant coordination and skill for full enjoyment, particularly in terms of the balance and agility required for surfing.

As is well known to participants in these activities, the quality of the surfing or body boarding experience is directly related to the contours of the beach and the quality of the waves, neither is which is controlled by man to any significant degree. Obviously, such devices are only useful for their intended purposes in very large bodies of water having significant wave action, or in "wave pools" found at a limited number of commercial water parks.

The present invention relates to modified water sport devices which facilitate and improve upon the usage of "non-motorized" water sports devices. The inventive devices permit the user to enjoy the experience of surfing, without the necessity for acquiring the balance and agility, compared to existing technologies.

Powered Water Sports Devices. Powered water sports devices range in size from personal water craft a few feet in length and displacing a few hundred pounds to massive yachts. The inventive subject matter is most analogous to the smallest of these vehicles. Motorized personal water craft ("PWC"), or "jetskis", are generally powered by a two-stroke internal combustion gasoline engine. PWCs have acquired a reputation as being very noisy, as producing more air and water pollution than traditional motorboats, and as being significantly less safe than traditional motorboats. Indeed, the National Parks Service ("NPS") has issued regulations banning PWCs from use in all units of the NPS unless NPS adopts unit-specific authorizations (36 C.F.R. §§3.24 (a), et seq. (2000)).

The present invention provides a novel "tow-behind" device combining the advantages of a personal water craft, such as the ability to ride such device while kneeling or standing and the availability of a handlebar for balance and user confidence, while avoiding the primary disadvantages—noise, pollution, and rider safety—which have been associated with motorized personal water craft.

SUMMARY OF THE INVENTION

The present invention relates to a novel non-motorized water sports device comprising:

(A) a hull (11) having a top surface, a bottom hydroplane surface (100), a bow (12), a stern (13), a foredeck surface (14), an aft deck surface (15) sized for accommodating at least one rider, at least one tow attachment point (16) located at said bow end, a longitudinal axis extending from the bow (12) to the stern (13), a vertical axis extending perpendicular to said longitudinal axis and normal to said bottom hydroplane surface (100), and a horizontal axis extending perpendicular to each of said longitudinal and vertical axes;

(B) a handle column (20) attached to said hull (11) at said foredeck surface (14);

(C) a handle bar (23) is attached to said handle column (20); and (D) at least one rudder fin (101), wherein each said rudder fin (101) is attached to said hull (11) through said bottom hydroplane surface (100) of said hull.

The present invention further relates to a non-motorized water sports device comprising:

(A) a hull (11) having a top surface, a bottom hydroplane surface (100), a bow (12), a stern (13), a foredeck surface (14), an aft deck surface (15) sized for accommodating at least one rider, at least one tow attachment point (16) located at said bow, a longitudinal axis extending from the bow (12) to the stern (13), a vertical axis extending perpendicular to said longitudinal axis and normal to said bottom hydroplane surface, and a horizontal axis extending perpendicular to each of said longitudinal and vertical axes;

(B) a handle column (20) pivotably attached to said hull (11) at said foredeck surface (14) for motion about said horizontal axis;

(C) a partially recessed foredeck top surface (17) formed within said top surface,
wherein said handle column (20) is attached to said hull (11) within said partially recessed foredeck top surface (17);

(D) a handle bar (23),
wherein said handle bar (23) is attached to said handle column (20);

(E) at least one rudder fin assembly (102) located within a cavity formed by at least one rudder assembly well (90) located between said aft deck surface (15) and said bottom hydroplane surface (100) of said hull (11),
wherein each said rudder fin assembly (102) has a rudder cable attachment point (31) and at least one rudder fin (101) pivotably attached to at least one rudder fin shaft (36),
and wherein said cavity formed by said rudder assembly well (90) additionally has a rudder assembly well cover (91) which is essentially coplanar with said aft deck surface (15) when installed;

(F) a rudder cable (32) having two ends, a first end attached to said handle bar (23) and a second end attached to said rudder fin assembly (102),
wherein each said rudder fin (101) is pivotably attached to said rudder fin assembly (102) and rudder cable (32) for motion around said vertical axis, while maintaining rigidity around said longitudinal axis and said horizontal axis;

(G) a handle column rudder-cable channel (24) located within or on the surface of said handle column (20), wherein said rudder cable (32) passes through said handle column rudder-cable channel (24); and (H) a hull rudder-cable channel (18) located within or on the surface of said hull (11),
wherein said rudder cable (32) passes through said hull rudder-cable channel (18).

DETAILED DESCRIPTION OF THE INVENTION

Definitions

Figure 1:
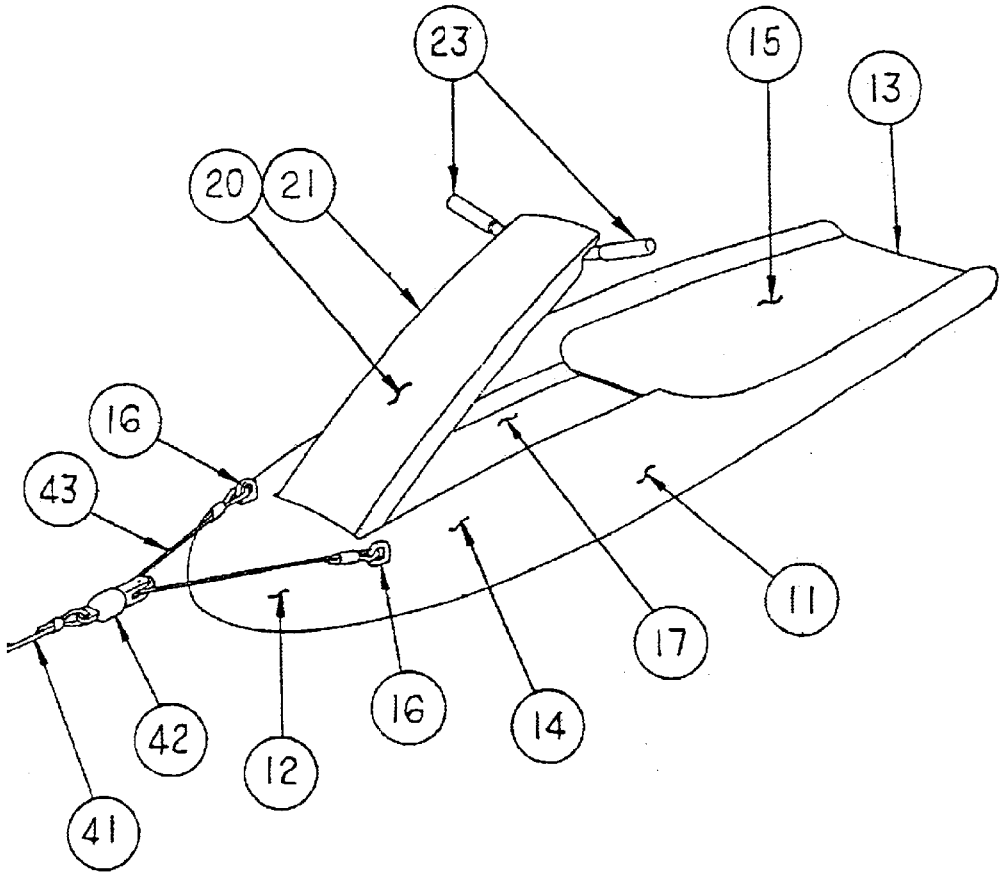
FIG. 1 is a drawing which depicts a front perspective view of a tow-behind water sports device.
Figure 2:
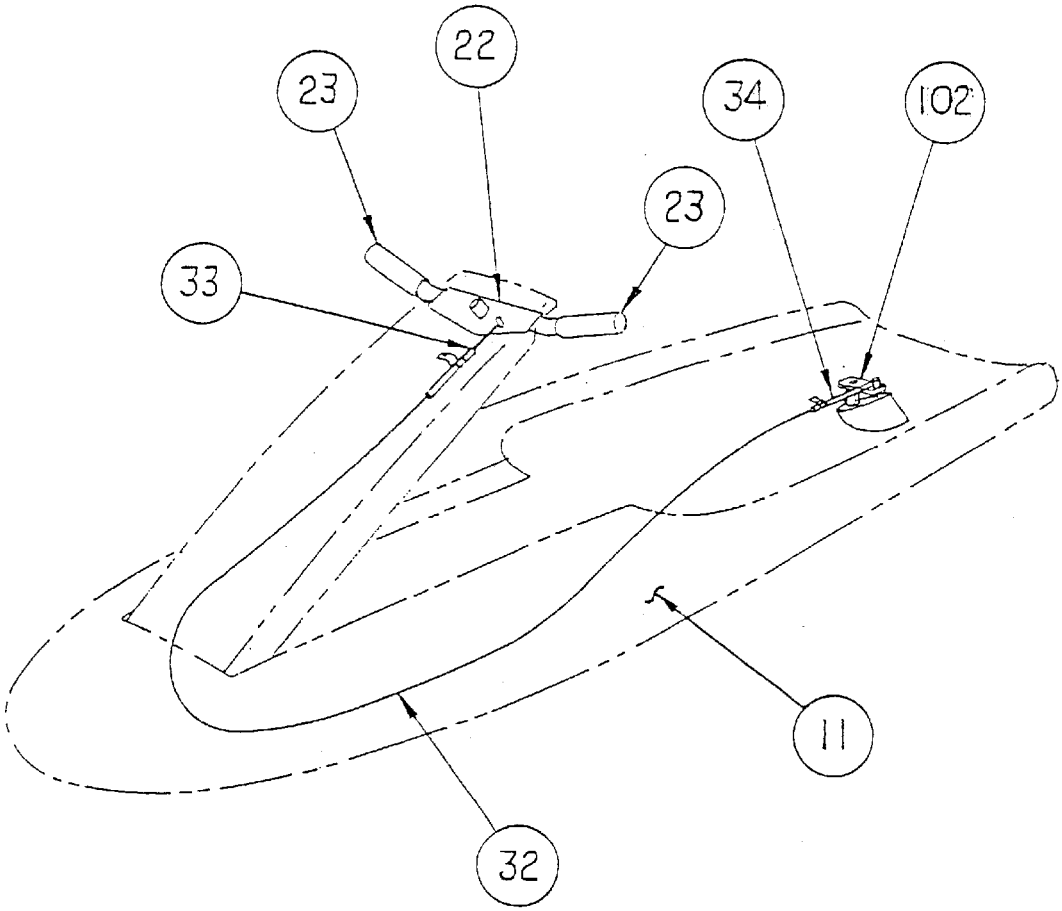
FIG. 2 is a drawing which depicts a front perspective outline view of a tow-behind water sports device, further depicting a handle bar, rudder assembly, and rudder cable for steering the device.
Figure 3:
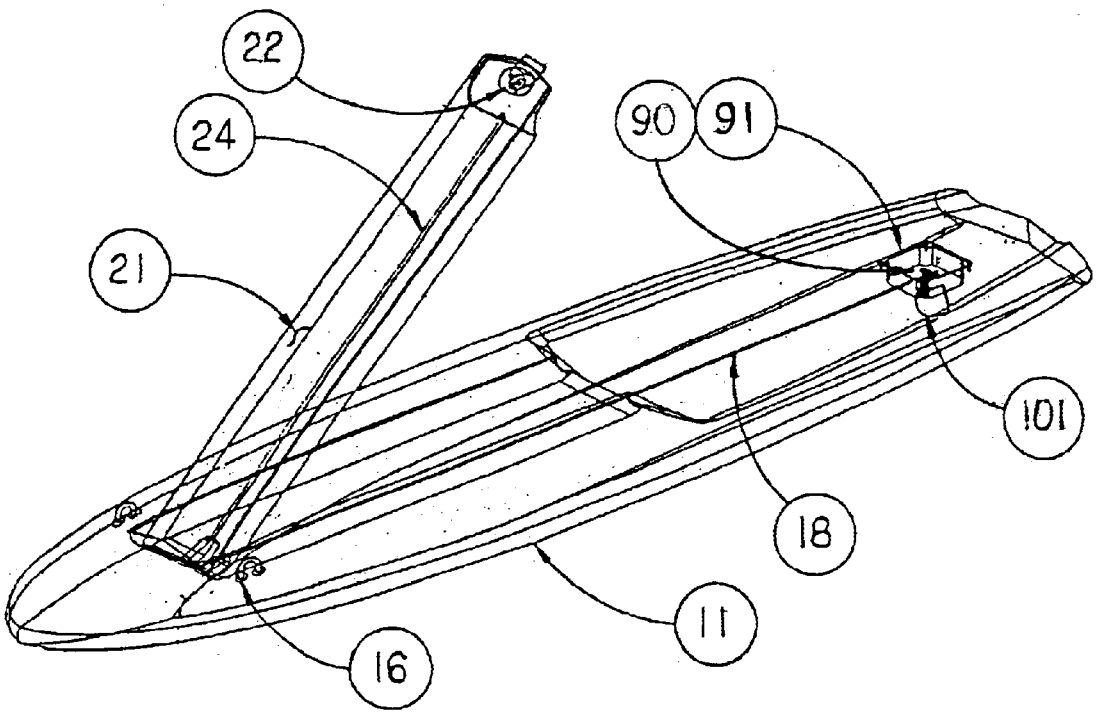
FIG. 3 is a drawing which depicts a front perspective view of a tow-behind water sports device, further depicting a handle bar base, rudder assembly well, and handle column and hull rudder cable canals for steering the device.
Figure 4:
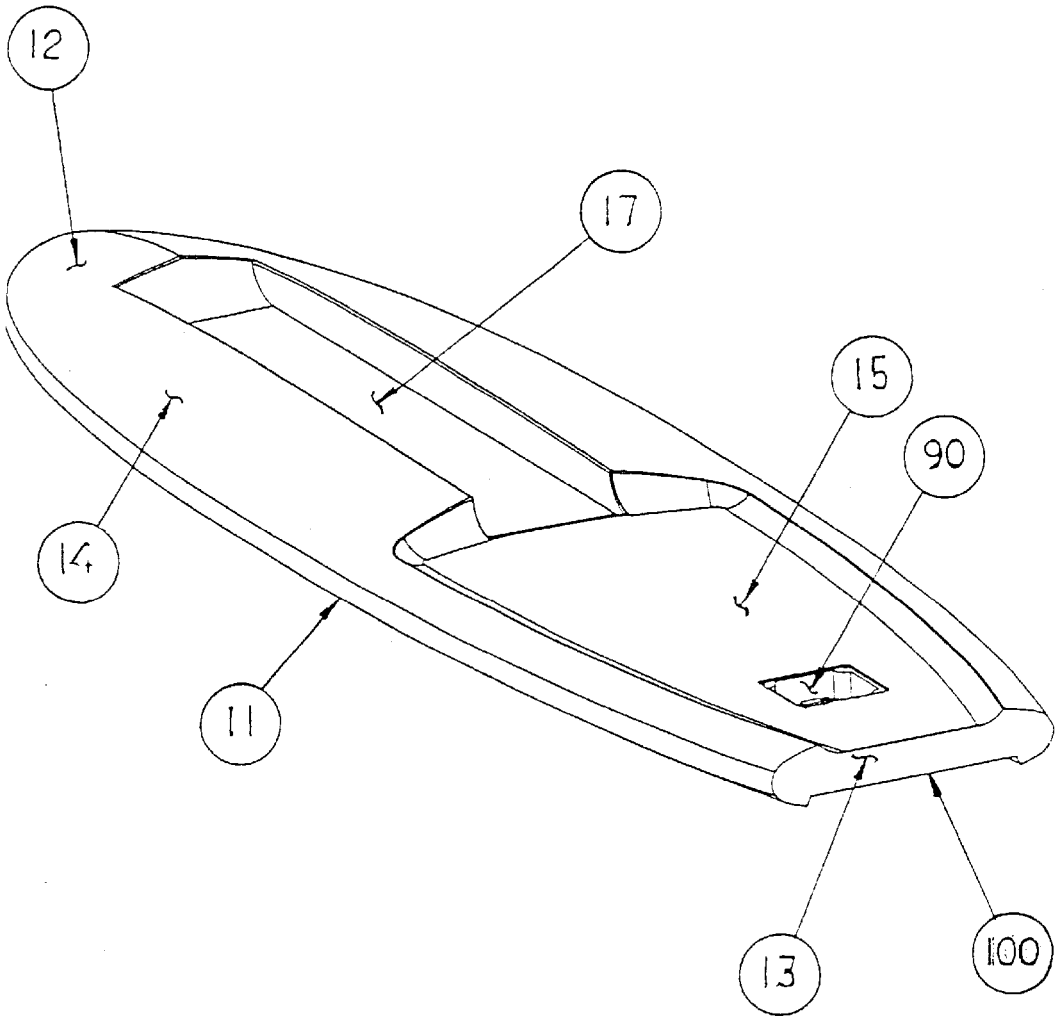
FIG. 4 is a drawing which depicts a rear perspective view of a tow-behind water sports device hull, further depicting an aft deck surface sized for accommodating at least one rider, a partially recessed foredeck top surface, and a rudder assembly well.
Figure 5:
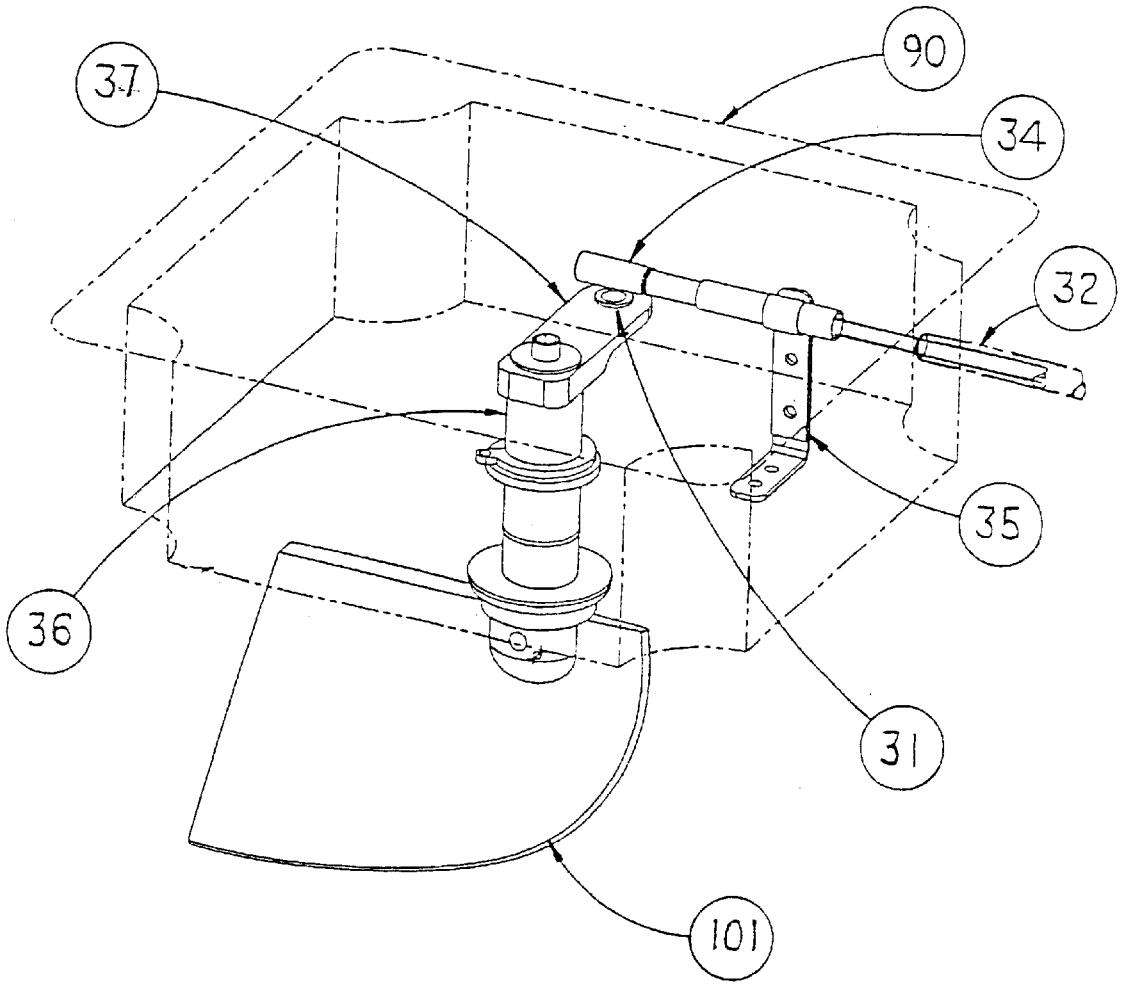
FIG. 5 is a drawing which depicts a side perspective outline view of a rudder assembly well, further depicting a typical rudder assembly comprising a rudder cable, a rudder cable bracket, a rudder fin shaft having a rudder fin turning arm with a rudder cable attachment point, and a rudder fin.
Figure 6:
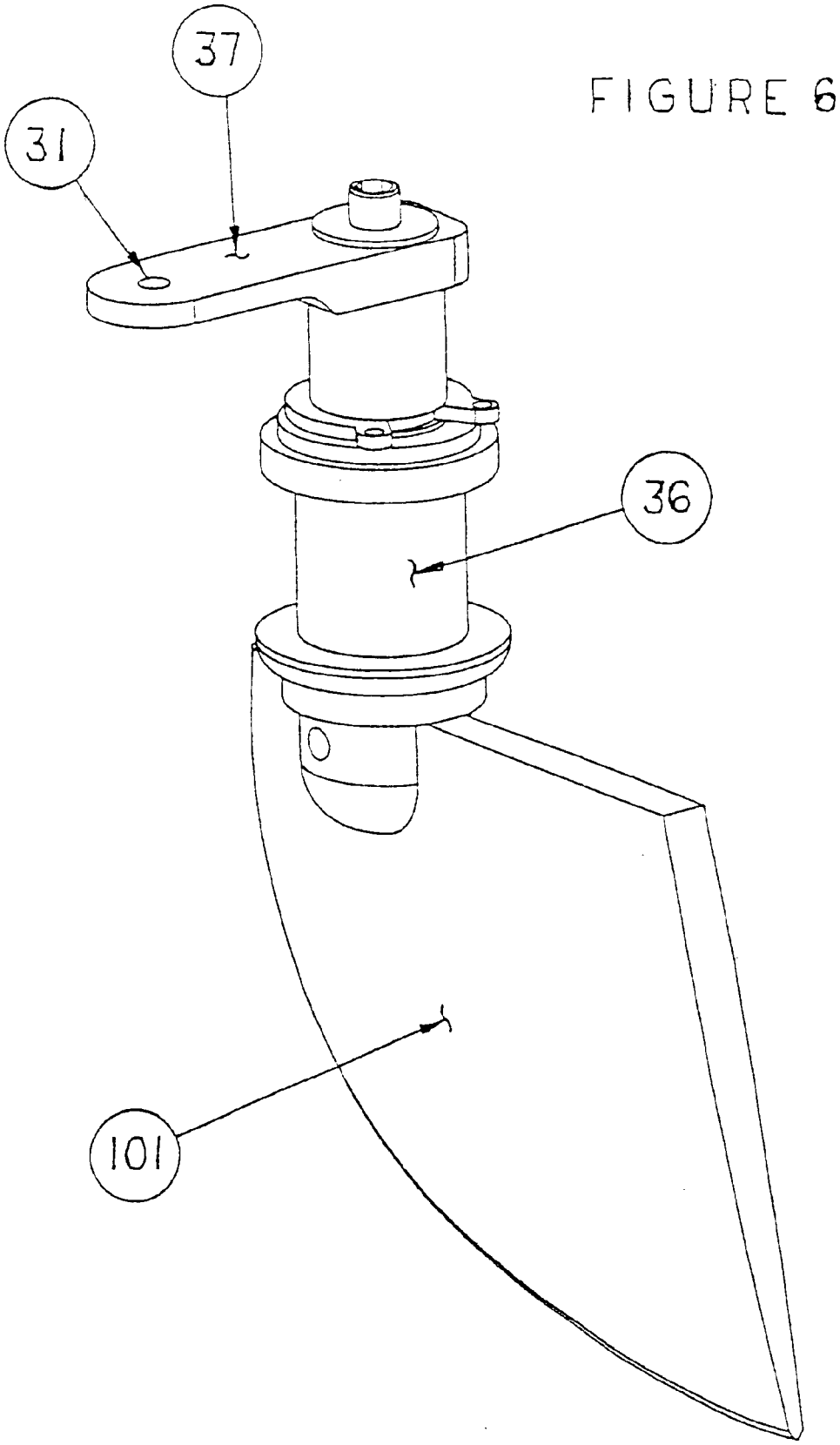
FIG. 6 is a drawing which depicts an isolated perspective view of a typical rudder assembly comprising a rudder fin, a rudder shaft, and a rudder turning arm having a rudder cable attachment point.
Figure 7:
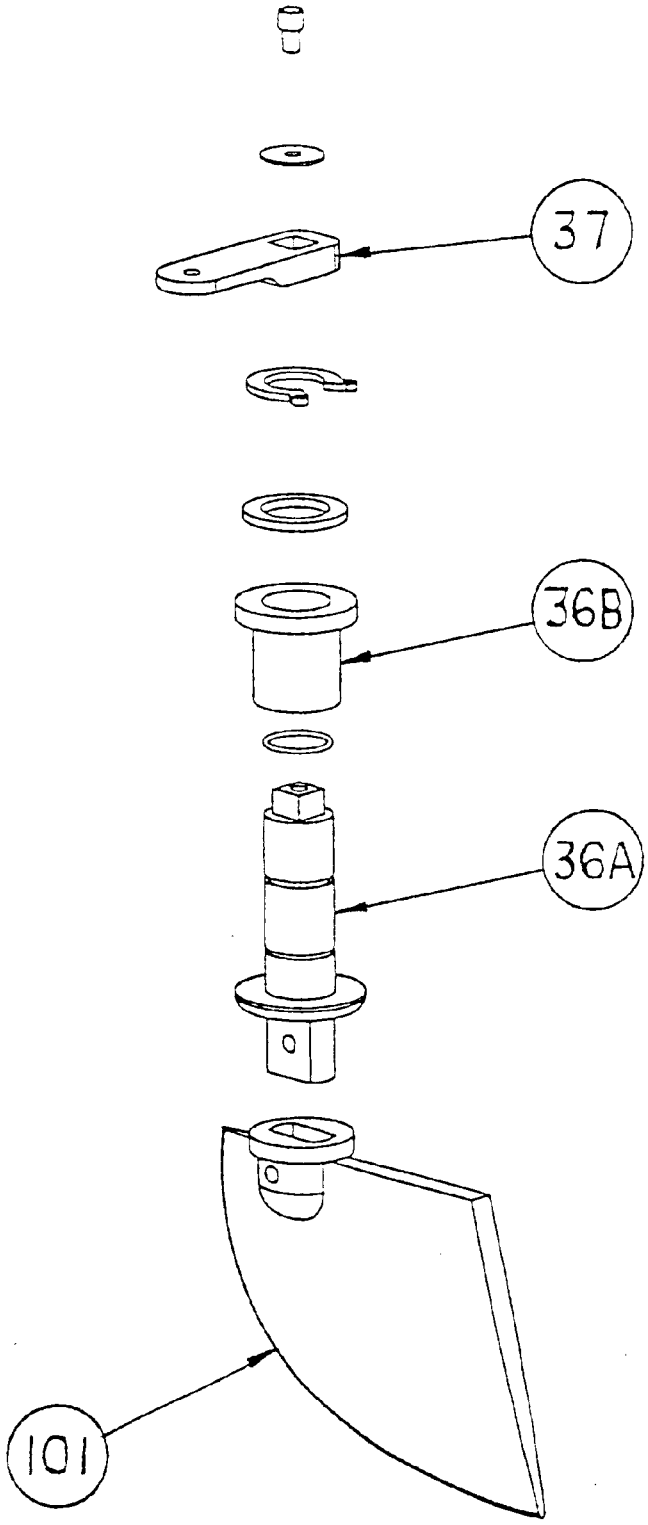
FIG. 7 is a drawing which depicts an exploded view of a typical rudder assembly comprising a rudder fin, a rudder shaft, a rudder turning arm having a rudder cable attachment point, and typical ancillary hardware.
Figure 8:
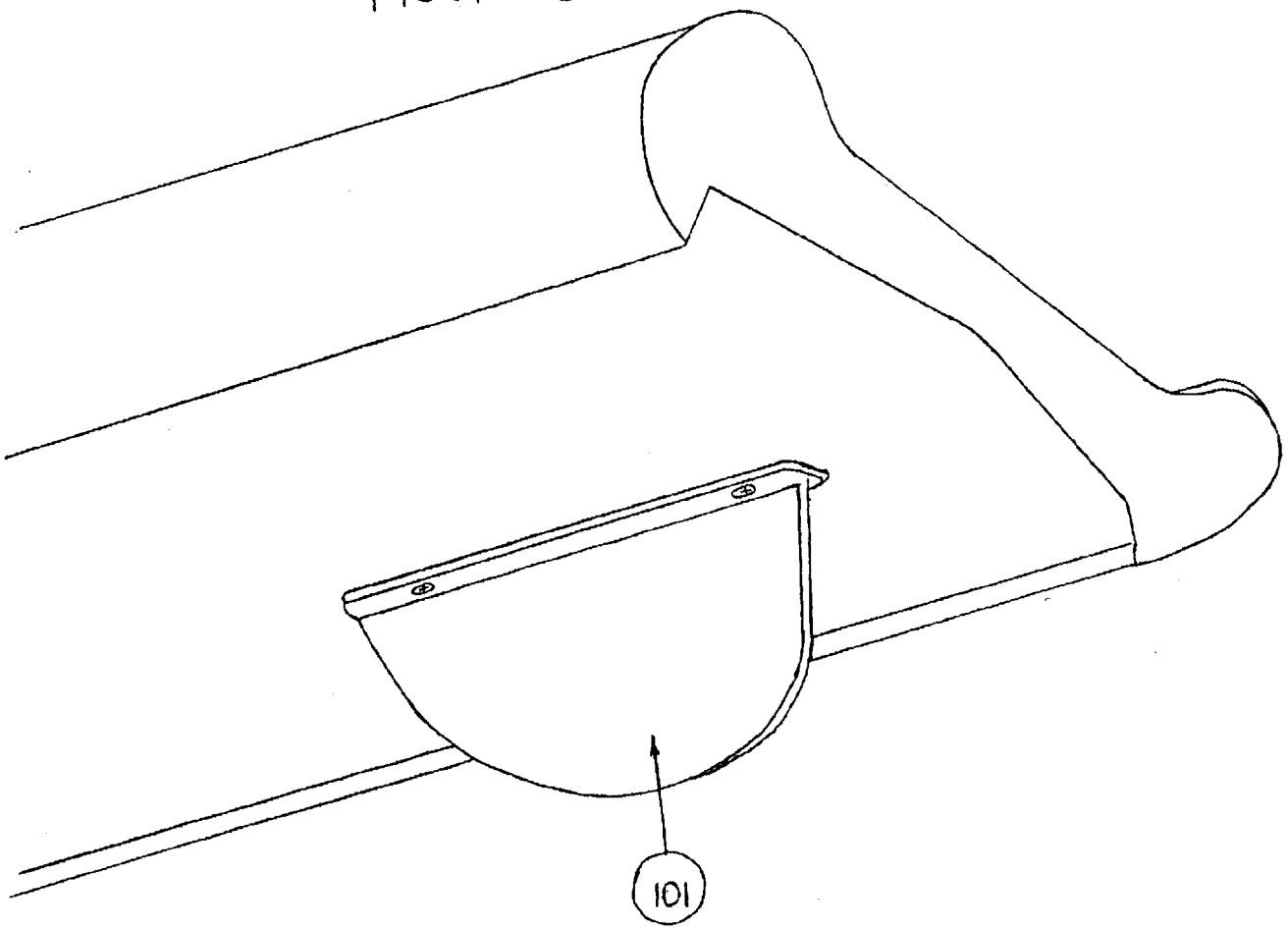
FIG. 8 is a drawing which depicts a rudder fin which is rigidly attached to a bottom hydroplane surface of a hull.
Figure 9:
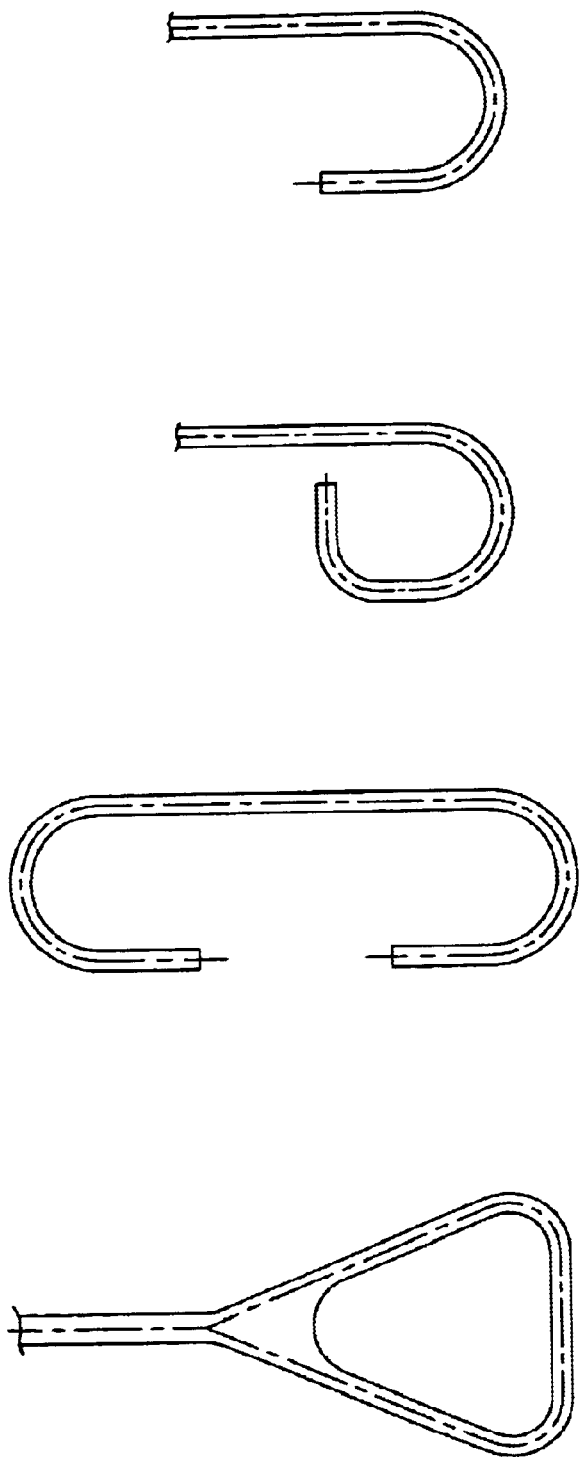
FIG. 9 is a drawing which depicts exemplary essentially looped portions of a handle bar having an essentially linear portion and at least one essentially looped portion.

"Attachment point" refers to hardware, known to artisans of ordinary skill in the art, for connecting two or more components together. Thus, for example, "tow attachment point" refers to a cleat, a ring, a bolt, or the like, which is attached to the hull of the instant device and is the mechanism for connecting the inventive device to the tow vehicle.

"Cable" refers broadly to a mechanism for conveying a signal. The cable disclosed herein includes mechanical, hydraulic, electrical, optical, and other mechanisms for conveying a signal. The preferred cable is a mechanical, solid or stranded wire cable having a outer housing, which together transmit force by a combination of tension on the inner cable and compression to the housing. The details of the transmission of a signal by mechanical, hydraulic, electrical, optical, and other mechanisms for conveying a signal is well known to one of ordinary skill in the art.

"Cable channel" refers to the path through which a control signal is passed. The cable channel disclosed herein includes, for example, a sheath for a mechanical cable, a tube for hydraulic fluid, an insulator for an electrical conductor, a fiber optic sheath for an optical fiber, and other mechanisms known to an artisan of ordinary skill in the art for conveying a signal. For the preferred wire cable, the preferred cable channel is selected from the group consisting of a continuous or segmented annular housing, at least one cable guide, at least one tubular passage on or through the body of the instant device, a combination thereof, and the like.

A Non-motorized Water Sports Device

The present invention relates to a novel non-motorized water sports device comprising:

(A) a hull (11) having a top surface, a bottom hydroplane surface (100) a bow (12), a stern (13), a foredeck surface (14), an aft deck surface (15) sized for accommodating at least one rider, at least one tow attachment point (16) located at said bow, a longitudinal axis extending from the bow (12) to the stern (13), a vertical axis extending perpendicular to said longitudinal axis and normal to said bottom hydroplane surface (100), and a horizontal axis extending perpendicular to each of said longitudinal and vertical axes;

(B) a handle column (20) comprising a handle pole (21) and a handle bar base (22),
wherein said handle column (20) is attached to said hull (11) at said foredeck surface (14);

(C) a handle bar (23),
wherein said handle bar (23) is attached to said handle column (20) at said handle bar base (22); and (D) at least one rudder fin (101),
wherein each said fin (101) is attached to said bottom hydroplane surface (100) of said hull (11).

In a preferred embodiment, said handle column (20) is rigidly attached to said hull (11) in an essentially normal orientation to the bottom hydroplane surface.

In another preferred embodiment, said handle column (20) is pivotably attached to said hull (11) for motion about said horizontal axis.

In another preferred embodiment, each said rudder fin (101) is rigidly attached to said bottom hydroplane surface (100) of said hull (11). In such preferred embodiment, the device is steered by the user shifting his/her body weight.

In another preferred embodiment, at least one rudder fin (101) is pivotably attached to said hull (11). In such preferred embodiment, the device is steered by the user turning the handle bar, activating the cable mechanism and conveying a turning signal to said rudder fin(s).

In a further preferred embodiment, said novel non-motorized water sports device additionally comprises:

at least one rudder fin assembly (102) attached to said hull (11), wherein each said rudder fin assembly (102) has a rudder cable attachment point (31) and at least one rudder fin (101) pivotably attached to said rudder fin assembly for motion about a vertical axis; and a rudder cable (32) for controlling at least one rudder fin, each said rudder cable having two ends, a first end attached to said handle bar (23) and a second end attached to said rudder fin assembly (102), wherein said handle bar has an attachment point for said first end of said rudder cable and said handle bar is pivotably attached to said handle column;

wherein each said rudder fin assembly (102) permits movement of said at least one rudder fin (101) around said vertical axis, but maintains rigidity around each of said longitudinal axis and said horizontal axis.

In a further preferred embodiment, said novel non-motorized water sports device additionally comprises:

a handle column rudder-cable channel (24) within said handle column (20), wherein said rudder cable (32) passes through said handle column rudder-cable channel (24); and a hull rudder-cable channel (18) within said hull (11), wherein said rudder cable (32) passes through said hull rudder-cable channel (18).

In a further preferred embodiment, said novel non-motorized water sports device additionally comprises:

a partially recessed foredeck top surface (17) defining a cavity, wherein said handle column (20) is attached to said hull (11) within said cavity formed by said partially recessed foredeck top surface (17).

In this preferred embodiment, it is further preferred that said handle column may pivot between an orientation which is essentially normal to said bottom hydroplane surface ("extended") and an orientation which is essentially parallel to the longitudinal axis ("folded"). When folded, the handle column fits essentially within the recessed cavity portion of said foredeck top surface.

In a further preferred embodiment, said handle bar (23) has an essentially linear portion with handle grips at the ends. In an alternate embodiment, said handle bar (23) has an essentially linear portion and at least one essentially looped portion to form a hand-hold from each looped portion. Preferably, two looped portions of said handle bar form two hand-holds.

In a highly preferred embodiment, the present invention relates to a novel non-motorized water sports device comprising:

(A) a hull (11) having a top surface, a bottom hydroplane surface (100) a bow (12), a stern (13), a foredeck surface (14), an aft deck surface (15) sized for accommodating at least one rider, at least one tow attachment point (16) located at said bow, a longitudinal axis extending from the bow (12) to the stern (13), a vertical axis extending perpendicular to said longitudinal axis and normal to said bottom hydroplane surface, and a horizontal axis extending perpendicular to each of said longitudinal and vertical axes;

(B) a handle column (20) comprising a handle pole (21) and a handle bar base (22), wherein said handle column (20) is pivotably attached to said hull (11) at said foredeck surface (14);

(C) a partially recessed foredeck top surface (17) which forms a cavity in said hull, wherein said handle column (20) is attached to said hull (11) within the cavity defined by said partially recessed foredeck top surface (17);

(D) a handle bar (23), wherein said handle bar (23) is attached to said handle column (20) at said handle bar base (22);

(E) at least one rudder fin assembly (102) located within a cavity formed by at least one rudder assembly well (90) located between said aft deck surface (15) and said bottom hydroplane surface (100) of said hull (11), wherein each said rudder fin assembly (102) has a rudder cable attachment point (31) and at least one rudder fin (101) pivotably attached to at least one rudder fin shaft (36), and wherein said cavity formed by each said rudder assembly well (90) has a rudder assembly well cover (91) which is essentially coplanar with said aft deck surface (15) when installed;

(F) a rudder cable (32) having two ends, a first end attached to said handle bar (23) and a second end attached to said rudder fin assembly (102), wherein each said rudder fin (101) is pivotably attached to said rudder fin assembly (102) for motion about a vertical axis;

(G) a handle column rudder-cable channel (24) within said handle column (20), wherein said rudder cable (32) passes through said handle column rudder-cable channel (24); and (H) a hull rudder-cable channel (18) within said hull (11), wherein said rudder cable (32) passes through said hull rudder-cable channel (18).

In a further preferred embodiment, the bow of said tow-behind water sports device is attached to a tow vehicle (not shown) by at least one tow cable (41). Said at least one tow cable is optionally attached directly to said at least one tow attachment point (16) or preferably attached to a swiveling device (42), which is further attached to said at least one tow attachment point (16), either directly, by a cable, or, most preferably, by a harness (43) passing through a pulley section of said swiveling device.

The tow vehicle for the devices of the present invention may be any craft having sufficient speed and power to pull the devices to planing speed. It is expected that the tow vehicle for the devices of the present invention will be a powerboat, such as a ski boat, or a PWC, although usage with small yachts is to be expected as well. In certain circumstances, for example when used in a canal or similar body of water, the devices of the present invention may also be towed by land vehicles such as a car or truck.

Various configurations of rudder fin assemblies are known to those of ordinary skill in the art. It is intended that the scope of the invention shall include all such rudder fin assemblies. Without limitation of the invention, a typical rudder fin assembly comprises the aft end of a rudder cable (34), a rudder cable bracket for holding said rudder cable (35), a rudder fin shaft (36) having a rudder fin turning arm (37) for turning said rudder, a rudder cable attachment point (31) for attaching said rudder cable to said rudder fin turning arm, and a rudder fin (101). It is known that typical rudder shafts may comprise additional, ancillary parts such as a shaft sleeve (36B) for passing a shaft (36A) through a wall, such as the bottom hydroplane surface wall of the hull (11). Additional, ancillary parts (such as nuts, bolts, washers, lock washers, lock rings, spacers, and the like) of said rudder fin assembly are also known to those of ordinary skill in the art, and are within the scope of the invention.

The invention being thus described, it will be obvious that the same may be modified or varied in many ways. A skilled artisan will recognize that the preferred embodiments of this invention may be used individually or together in many various combinations and permutations. Selection of the features to be included in a particular embodiment will be governed by practical and market considerations such as rider comfort, ease of use, cost, and performance characteristics. Such modifications and variations are not to be regarded as a departure from the spirit and scope of the invention and all such modifications and variations are intended to be included within the scope of the following claims.

I claim:

1. A non-motorized water sports device comprising:

(A) a hull having a top surface, a bottom hydroplane surface, a bow, a stern, a foredeck surface, an aft deck surface sized for accommodating at least one rider, at least one tow attachment point located at said bow end, a longitudinal axis extending from the bow to the stern, a vertical axis extending perpendicular to said longitudinal axis and normal to said bottom hydroplane surface, and a horizontal axis extending perpendicular to each of said longitudinal and vertical axes;

(B) a handle column pivotably attached to said hull at said foredeck surface for motion about said horizontal axis;

(C) a partially recessed foredeck top surface formed within said top surface, wherein said handle column is attached to said hull within said partially recessed foredeck top surface;

(D) a handle bar attached to said handle column; and (E) at least one rudder fin assembly.

2. The non-motorized water sports device of claim 1, wherein each said rudder fin assembly comprises a rudder fin which is rigidly attached to said bottom hydroplane surface of said hull.

3. The non-motorized water sports device of claim 1, wherein each said rudder fin assembly is located within a cavity formed by at least one rudder assembly well located between said aft deck surface and said bottom hydroplane surface of said hull, wherein each said rudder fin assembly has a rudder cable attachment point and at least one rudder fin pivotably attached to at least one rudder fin shaft, and wherein said cavity formed by each said rudder assembly well additionally has a rudder assembly well cover which is essentially coplanar with said aft deck surface when installed;

(i) a rudder cable having two ends, a first end attached to said handle bar and a second end attached to said rudder fin assembly, wherein each said rudder fin is pivotably attached to said rudder fin assembly and rudder cable for motion around said vertical axis, while maintaining rigidity around said longitudinal axis and said horizontal axis;

(ii) a handle column rudder-cable channel located within or on the surface of said handle column, wherein said rudder cable passes through said handle column rudder-cable channel; and (iii) a hull rudder-cable channel located within or on the surface of said hull, wherein said rudder cable passes through said hull rudder-cable channel.

4. The non-motorized water sports device of claim 1, wherein said handle bar has an essentially linear portion and at least one essentially looped portion.

* * * * *